US008813839B2

(12) United States Patent
Head

(10) Patent No.: US 8,813,839 B2
(45) Date of Patent: Aug. 26, 2014

(54) METHOD OF DEPLOYING AND POWERING AN ELECTRICALLY DRIVEN DEVICE IN A WELL

(75) Inventor: Philip Head, Egham (GB)

(73) Assignee: Artificial Lift Company, Egham (GB)

( * ) Notice: Subject to any disclaimer, the term of this patent is extended or adjusted under 35 U.S.C. 154(b) by 365 days.

(21) Appl. No.: 13/040,597

(22) Filed: Mar. 4, 2011

(65) Prior Publication Data

US 2012/0222853 A1 Sep. 6, 2012

(51) Int. Cl.
*E21B 17/00* (2006.01)

(52) U.S. Cl.
USPC ..... 166/242.6; 166/385; 166/65.1; 166/381

(58) Field of Classification Search
None
See application file for complete search history.

(56) References Cited

U.S. PATENT DOCUMENTS

| | | | | |
|---|---|---|---|---|
| 3,835,929 | A | 9/1974 | Suman, Jr. | |
| 3,939,705 | A | 2/1976 | Glotin et al. | |
| 4,105,279 | A | 8/1978 | Glotin et al. | |
| 4,494,602 | A | 1/1985 | Capdeboscq et al. | |
| 4,589,717 | A | 5/1986 | Pottier et al. | |
| 5,180,140 | A | 1/1993 | Araki | |
| 5,191,173 | A | 3/1993 | Sizer | |
| 5,746,582 | A | 5/1998 | Patterson | |
| 5,871,051 | A | 2/1999 | Mann | |
| 6,164,375 | A * | 12/2000 | Carisella | 166/65.1 |
| 6,415,869 | B1 | 7/2002 | Smith | |
| 7,640,993 | B2 * | 1/2010 | Head | 166/385 |

FOREIGN PATENT DOCUMENTS

| | | |
|---|---|---|
| EP | 0470 576 A1 | 2/1992 |
| EP | 0745 176 B1 | 4/1998 |
| WO | WO 98/22692 | 5/1998 |

* cited by examiner

*Primary Examiner* — Jennifer H Gay
*Assistant Examiner* — Caroline Butcher
(74) *Attorney, Agent, or Firm* — Greenberg Traurig, LLP

(57) ABSTRACT

A system for installing a powered device in a downhole tube, comprising a power line disposed along a production tube and terminating in a first power connector and an orientation profile disposed in the vicinity of the first power connector. An assembly includes a powered device having a second power connector and an extending orientation capable of radial outward movement from the assembly. The powered device being lowered down the production tube, causing the extending orientation to be urged radially outwards to engage with the orientation profile and orient the device, so that the first power connector and second power connector engage to connect the powered device to the power line in an automatic manner.

18 Claims, 4 Drawing Sheets

METHOD OF DEPLOYING AND POWERING AN ELECTRICALLY DRIVEN DEVICE IN A WELL

This invention relates to a method of deploying an electrical submersible powered fluid transducer system, such as a gas compressor or an electrical submersible pump, generally known as an ESP, in an oil and/or gas production well.

The disposing in wells of electrical submersible systems has been done for many years using jointed tubular conduits with an electrical motor, and a fluid transducer connected to the bottom of the jointed tubing. Consecutive joints of tubular conduits are connected and lowered into a well with the assistance of a rig mast and hoisting equipment, whilst unspooling and connecting to the outer diameter of the tubing a continuous length of electrical power transmission cable. This method of disposing the electrical submersible fluid transducer system is well know to those familiar with the art of producing non-eruptive sources of oil and gas from the subterranean environment. The retrieval of these electrical submersible fluid transducer systems is also commonly accomplished by pulling the jointed tubing out of the well simultaneously with the electrical submersible motor and fluid transducer system and the electrical power transmission cable. The following prior art references are believed to be pertinent to the invention claimed in the present application: U.S. Pat. Nos. 3,939,705; 4,105,279; 4,494,602; 4,589,717; 5,180,140; 5,746,582 and 5,871,051; International patent application No. WO98/22692 and European patent specifications Nos. 470576 and 745176. U.S. Pat. Nos. 3,835,929, and 5,191,173 teach the art of deploying and retrieving an electrical submersible system in oil wells using coiled or continuous tubing. These coiled tubing disposal methods often use large coiled tubing spool diameters owing to the radius of curvature possible of the continuous tubing. Hence the surface spooling devices that these systems require to inject and retrieve the continuous tubing are cumbersome, and require special surface and subterranean equipment for deployment and intervention.

Other previous art disclosed in the literature teaches the disposal and retrieval of the subterranean electrical fluid transducer system with wireline or wire rope as structural support for simultaneously disposing the electrical power transmission cable with the system. Hence these wireline methods and apparatus involve the use of large and unique surface intervention equipment to handle the weight and spool used for the electrical power cable and the wire rope to be run in the well. U.S. Pat. No. 5,746,582 discloses the retrieval of a submersible pumps whilst leaving an electrical motor and cable in a well. Hence the method of U.S. Pat. No. 5,746,582 teaches the retrieval and deployment of the mechanical portion of an electrical submersible fluid transmission system whilst leaving the electrical motor and other component parts of the electrical submersible system disposed in the disposal of the electrical motor separately from the electrical power transmission cable. In the case of artificially lifted wells powered with electrical submersible motor systems, the current art is to dispose the required transducer assembly, for example a pump or compressor assembly, with an electrical motor and electrical power cable simultaneously into the well with a supporting member. This supporting member is jointed tubing from a surface rig, a coiled tubing unit with continues tubing or braided cable. The tubing or a braided cable is required as the electrical power cable is not able to support its own weight in the well and hence must be connected and disposed in the well with a structural member for support. In the case of jointed pipe deployed from a rig, the power cable is attached to the electrical motor on surface, and the cable is attached to the tubing as the electrical motor, transducer, and tubing are disposed into the well casing or tubing. The attachment of the cable to the tube is done by the use of steel bands, cast clamps, and other methods known to those familiar with the oil and gas business. In other methods, the power cable is placed inside of continuous tubing or attached to the outside of continuous tubing with bands as taught by U.S. Pat. No. 5,191,173. This continuous tubing is often referred to in the industry as coiled tubing. U.S. Pat. No. 3,835,929 teaches the use of the continuous tubing with the electrical power transmission cable inside of the tube. In all cases where electrical submersible fluid transducers systems are disposed and retrieved from wells the electric motor and electrical power transmission cable are deployed or retrieved simultaneously.

It is well known to those familiar with electrical submersible power cable that the action of removing the cable from the well can result in damage to the electrical power transmission cable, in a variety of ways. The damage inflicted on the electrical power cable can be due to bending stresses imposed on the cable during the disposal and retrieval. The conventional electrical power cable insulation, wrapping, and shields can develop stress cracks from the spooling of the cable over sheaves and spools devices used to deploy the cable. Another failure mode associated with submersible power transmission cable is caused form impact loads or crushing of the cable as it is disposed or retrieved in the wells. It is also well known that gases found in subterranean environments impregnated the permeability of the electrical power transmission cable's insulation, wrapping and shields. This gas is trapped in the permeability of the insulation at a pressure similar to the pressure found inside the well. When the cable is retrieved from the well the electrically powered transmission cable is exposed to ambient pressures. This will create a pressure differential between gas encapsulated in the cable insulation and the ambient surface pressure conditions. The rate of impregnated gas expansion from the higher pressure inside of the cable insulation expanding towards the lower pressure of the ambient conditions can sometimes exceed the cable insulation permeability's ability to equalise the pressure differential. The result is a void, or stressing of the insulation, and premature failure of the cable. The requirement to retrieve and dispose the electrical power transmission cable with the electrical submersible fluid traducer system also requires the use of specialised surface intervention equipment. This can require very large rigs, capable of pulling tubing, electrical power transmission cable, and electrical submersible fluid transducers. In the offshore environment these well intervention methods require semi-submersible drill ships and platforms. In the case of jointed conduit deployed in a plurality of threaded lengths, normally 9-12 m each, the pulling equipment is a drilling or pulling rig at surface. In the case that the electrical power transmission cable and assembly are disposed connected to or in continuous tubing, a specialised coiled tubing rig is required at surface. This coiled tubing unit consisting of an injector head, a hydraulic power unit, and a large diameter spooling device containing the continuous coiled tubing all located on the surface. This disposal and retrieval method requires significant space at the earth's surface or sea floor. The reasons for intervening in a well to retrieve or dispose an electrical submersible transducer system are well know to those familiar with the art of fluid removing fluids from wells. There are at least two classical reasons for intervention in wells disposed with electrical submersible fluid transducer systems. These include the need to increase fluid production, or the need to repair the disposed electrical submersible power system. The reason for requiring increased fluid production is dependent on many factors including but not limited to economical and reservoir management techniques discussed in the literature. The reasons for intervening for repair or to replace the electrical submersible fluid transducer systems are due to normal equipment wear and the subsequent loss of fluid production capacity, catastrophic equipment failure, and changes in the fluid production capacity of the subterranean fluid reservoir. The equipment failures can be caused due to subterranean electrical failures in the electrical motor windings, electrical motor insulation degradation due to heat or mechanical wear, conductive fluid leaking into the motor, wear or failure of the fluid transducer parts, wear of electrical motor bearings, shaft vibrations, changes in inflow performance of the reservoir, and other phenomena known to those familiar with the art of fluid production from wells. Therefore, it is often required to change out component parts of the electrical submersible fluid transducer system, but not necessarily the electrical power transmission cable. However, owing to prior art the power cable is retrieved when the electrical motor or the motor seals fail.

According to the present invention, there is provided a system for installing a powered device in a downhole tube, comprising a power line disposed along a production tube, terminating in a first power connector, an orientation profile disposed in the vicinity of the first power connector, and an assembly including a powered device including a second power connector and an extending orientation means capable of radial outward movement from the assembly. The powered device is lowered down the production tube, causing the extending orientation means to be urged radially outwards to engage with the orientation profile and orient the device, so that the first power connector means and second power connector means engage to connect the powered device to the power line in an automatic manner.

FIG. 1*a* shows a side view of the well casing and production tubing installed in a well.

FIG. 1*b* shows a side view of the ESP system to be deployed in the production tubing of FIG. 1*a;*

Figure 1A:
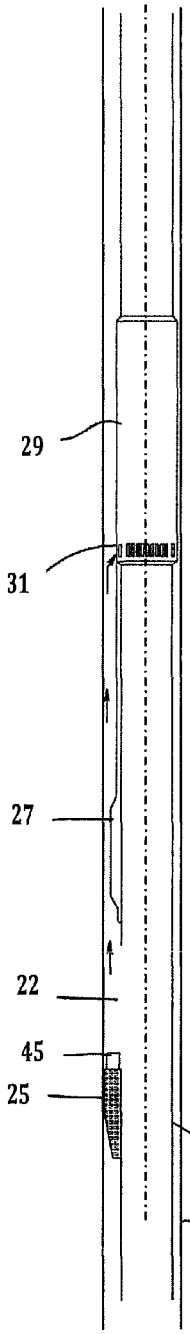

Referring to FIG. 1*a*, a production tubing 20 is disposed in a well casing 10. The production tubing includes an upwardly pointing electrical wet connect 25, beneath a window 22 in the production tubing 20. The production tubing also includes a profile 27 above the window 22, and further up the production tubing 20 is an motor can 29 where the production tubing 20 has a larger internal and external diameter than the rest of the production tubing. The motor can includes inlet slots 31.

The wet connect 25 is supplied with power from the surface, for example using a power cable disposed in the annulus between the production tubing 20 and the casing 30.

Figure 1B:
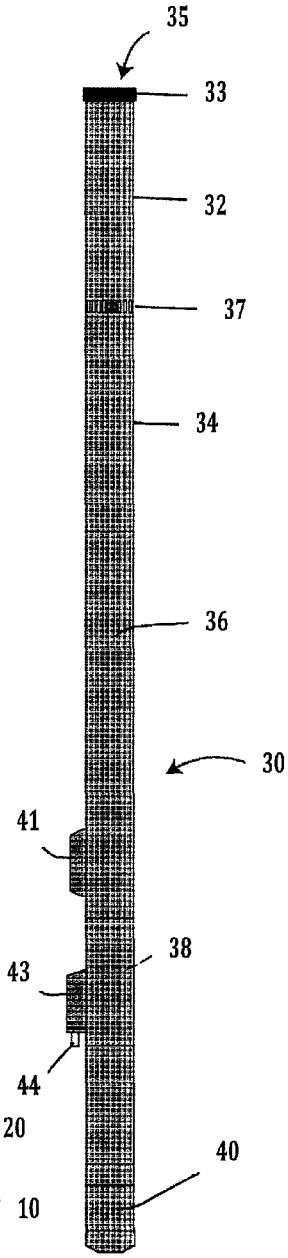

Referring also to FIG. 1*b*, an ESP assembly 30 comprises a pump 32, motor 34, long skate assembly 36, electrical plug assembly 38 and an instrumentation assembly 40. The long skate assembly 36 includes a skate 41 radially protruding from the main body of the long skate assembly. The electrical plug assembly 38 includes a plug 43 radially protruding from the main body of the electrical plug assembly 38.

Figure 2:
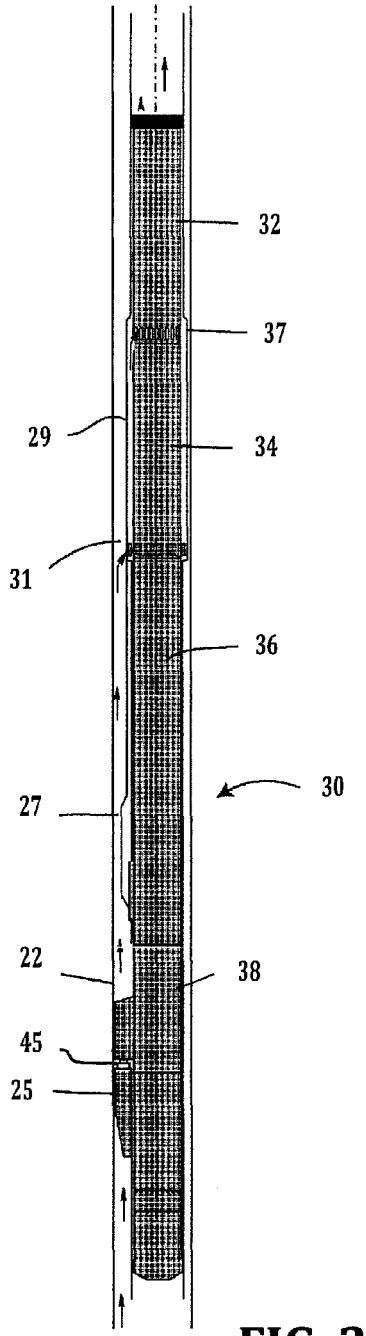
FIG. 2 shows a side view of the ESP system actually deployed in the production tubing.

Referring to FIG. 2, in operation the ESP assembly 30 is deployed in the production tubing 20 from a wireline (not shown) having a standard GS pulling tool profile, so that the wireline can be disconnected after the ESP assembly has fully deployed, and if necessary the ESP assembly may be retrieved at some future point. The electrical contact 44 of the plug 43 contacts the electrical contact 45 of the wet connect 25.

In operation, the wet connect 25 suppliers power to the motor 34 via the electrical plug 43. The motor 34 drives the pump 32, so that well fluid is drawn up from beneath production tubing 20 in the annulus between the well casing 10 and the production tubing 20, until it reaches the inlet slots 31 in the production tubing 20 (the annulus above the well casing 10 and the production tubing 20 is sealed at some point above the inlet slots 31). Well fluid is thence drawn up through the annulus between the motor 34 and the production tubing 20 in the motor can 29 of the production tubing, before entering the pump inlet 37. The fluid is then ejected from the pump 32 through a pump outlet 35 located above a pack off seal 33 on the pump which seals the outer diameter of the pump 32 against the production tubing 20. The well fluid then continues up the production tubing 20 until the surface of the well.

Figure 3:
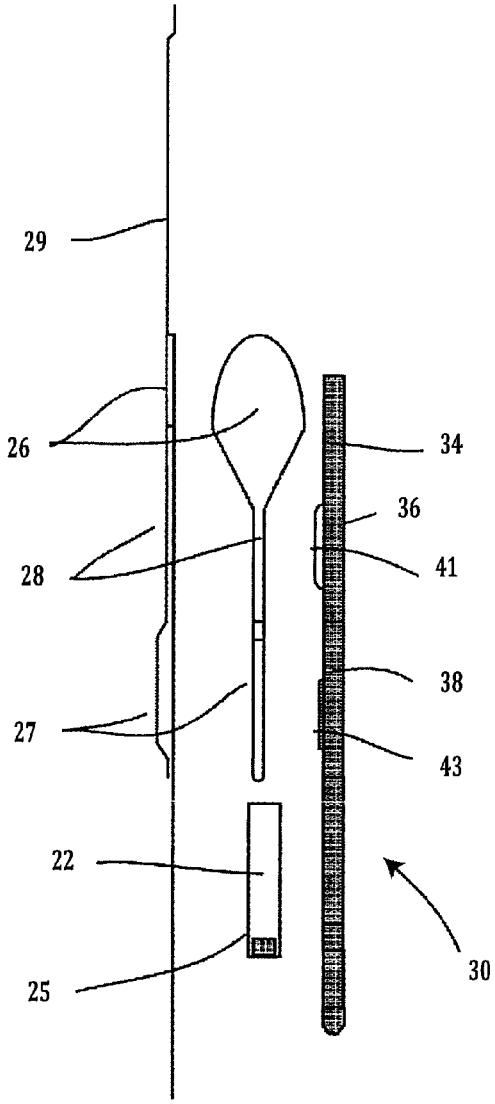
FIG. 3 shows a diagrammatic view of the ESP system and the production tubing during the ESP's deployment.

Referring to FIG. 3, this shows a representation of the side profile together with a face on view of the production tube 20, beside the ESP assembly 30. The skate 41 and the plug arm 43 are both radially extendable from the long skate assembly 36 and the electrical plug assembly 38 respectively. The radial movement of the skate 41 is outwardly biased. Further, the radial movement of the skate 41 activates the radial movement of the plug arm; the mechanisms for this will be described in more detail below after describing the general wet connect installation procedure.

The motor can 29 of the production tubing 20 features a funnel shaped profile 26 on the side of the production tubing wall. More accurately, FIG. 3 shows the profile on the inner surface of the production tubing as if the tubing were unfurled and pressed flat; the top of the 'funnel' profile is actually defined by an ellipse lying at a slanted angle to the axis of the assembly, extending around the entire circumference of the inside of the production tubing 20

As the ESP assembly 30 is lowered, the skate 41 engages with the funnel shaped profile 26. The funnel shaped profile 26 then narrows to a channel 28, so that as the ESP assembly 30 is lowered further, the skate 41, which engages the funnel whatever orientation the assembly happens to be at as it descends, and is forced to align itself with the channel 28, in turn aligning the entire ESP assembly 30.

Figure 4:
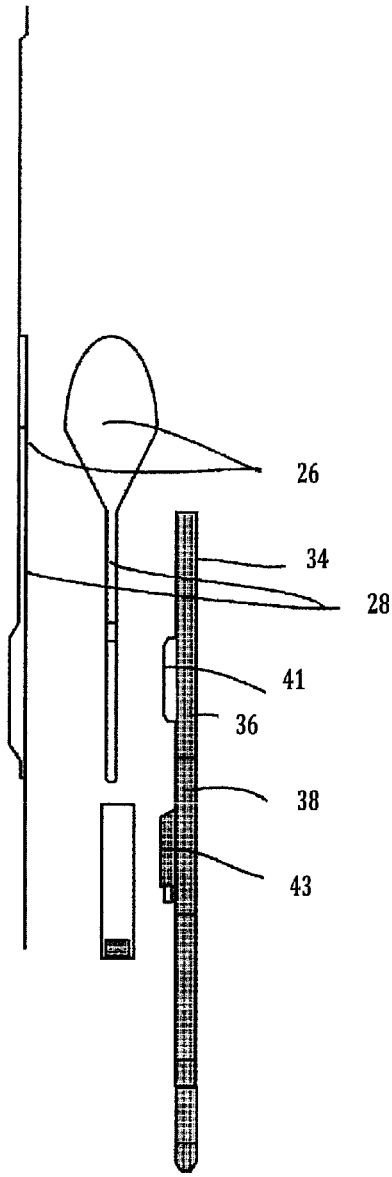
FIG. 4 shows a diagrammatic view of the ESP system and the production tubing at a later stage of the ESP's deployment.
Figure 5:
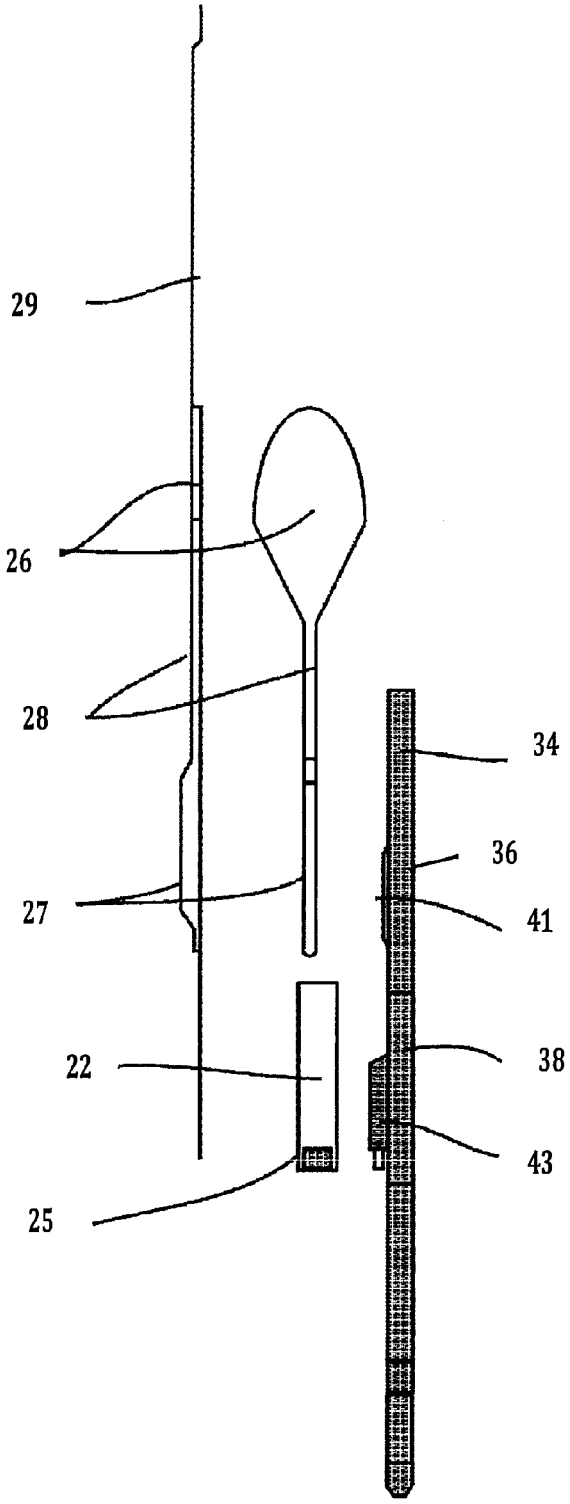
FIG. 5 shows a diagrammatic view of the ESP system and the production tubing at the final engaged stage of the ESP's deployment.

Referring to FIG. 4, further lowering of the ESP assembly 30 causes the skate 41 to follow the profile 27. This in turn activates the plug arm 43 to extend from the electrical plug assembly 38 so that the plug arm protrudes through window 22. Finally, referring to FIG. 5, the skate 41 reaches the bottom of profile 27 and is pressed back into the long skate assembly 36 by the profile 27 to protect the skate 41 from become scaled up. At the same time, the plug arm 43 engages with the wet connect 25 to supply the ESP assembly 30 with power.

Figure 6:
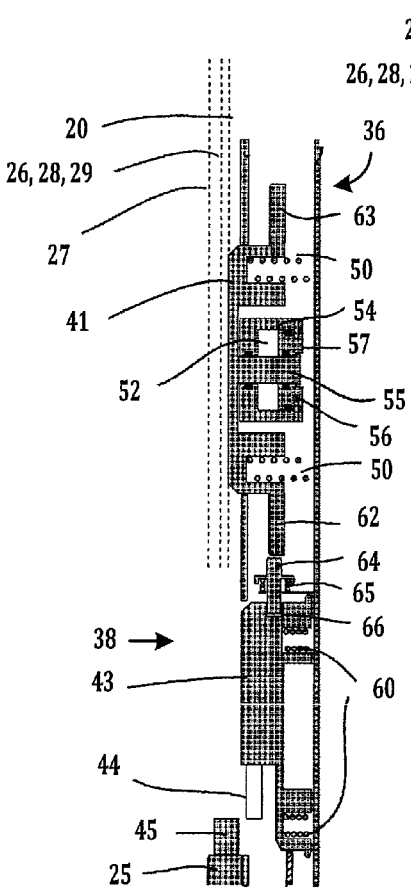
FIGS. 6 to 8 shows a sectional side view of the engaging and connecting portions of the ESP system through the stages of deployment and final connection.

Referring to FIG. 6, the skate 41 bears against various inner radii of the production tubing 20 and profiles upon the production tubing; a first inner radius of the production tubing 20 itself, a second inner radius of the motor can 29, funnel 26 and channel 28, and a third inner radius of the profile 27, are respectively represented by three dotted lines.

The skate 41 contained in long skate assembly 36 is outwardly biased by springs 50, however the skate includes a piston 55 which is constrained from outward movement by engaging with a restraint ring 56, which is in turn attached by shear pins 57 to a fixed cylinder 54 (the fixed cylinder being immovably attached to the long skate assembly 36 itself). A chamber 52 between the restrain ring 56 and the fixed cylinder 54 is at atmospheric pressure. In the state, the skate is not deployed, and the ESP assembly 30 can be run past large internal diameter well parts near the surface.

As the ESP assembly 30 is lowered down the well, the long skate assembly 36 is open to the well environment, and the hydrostatic pressure increases. At a sufficient depth (say when the hydrostatic pressure reaches 1000 psi), there is sufficient force on the restraint ring 56 between the hydrostatic pressure on one side and the atmospheric pressure of chamber 52 to force the restraint ring 56 to break the shear pins 57 and force the restrain ring radially outwards, compressing the chamber 52. The piston 55 of the skate 41 is now no longer constrained by the restraint ring 56, and the skate 41 is now free to move radially outwards until its progress is constrained by the inner diameter of the part of well it has reached (or until legs 62, 63 of the skid 41 abut the housing of the assembly 36), as shown in FIG. 8.

Referring back to FIG. 6, the plug arm 43 is also biased radially outwards by a spring 60. The plug is constrained however by a release pin 64, which engages with a slot 66 on the plug arm 43. The release pin 64 is upwardly biased by a spring 65. While the skid 41 is still in its undeployed position, a downwardly extending leg 62 abuts the release pin 64, so that the release pin remains engaged with the plug arm 43.

Figure 7:
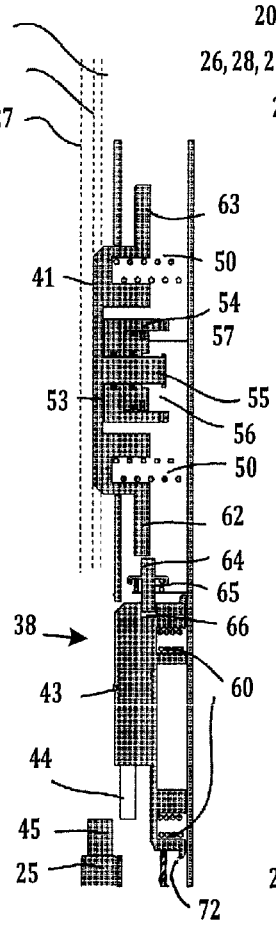
Figure 8:
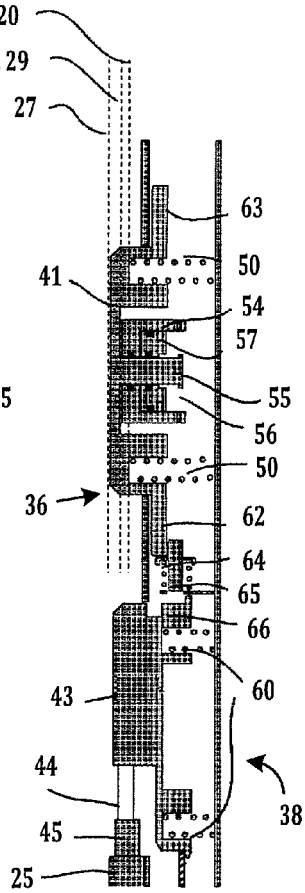

Referring to FIGS. 7 and 8, as the skid 41 moves radially outward to into profile 27, the leg 62 moves sufficiently to allow the release pin 66 to move upwards. This releases the plug arm 43, so that spring 60 pushes the plug arm radially outwards until it is constrained by the retaining lugs 72 abutting the housing of the plug assembly 38, or by abutting some profile in the production tubing 20 or well casing 10. Whatever method is used to constrain the plug arm 43 once released, it is displaced a predefined distance through the window 22 in order that the contact 44 of the plug arm 43 is aligned with the contact 45 of the wet connect 25. As the ESP assembly is lowered, the plug arm 43 and wet connect 25 engage, so that an electrical connection is made.

After the release pin 65 has disengaged from the plug arm 43, it lies to one side of the leg 62 of the skid 41, with a shoulder portion of the pin 65 abutting the leg 62. The release pin does not however constrain the skid 41, though and the skid is free to move radially inwards should the profile of the tubing the skid is in pushes the skid back inside the assembly 36.

The ESP assembly may be removed, by using a fishing tool to connect with a GS profile above the pump 32 (not shown). As the ESP assembly is pulled up the production tubing, the skid 41 and plug arm 34 are pushed radially inwardly into the long skid assembly 36 and plug assembly 38 by the inner diameter of the part of the tubing they happen to be at, allowing the ESP assembly to move freely.

The invention claimed is:

1. A system for installing a powered device in a downhole tube, comprising:

a power line disposed along a production tube, terminating in a first power connector;

an orientation profile disposed in the vicinity of the first power connector; and an assembly including:

a powered device including a second power connector, and an extending orientation means capable of radial engagement in the orientation profile;

the extending orientation means being configured to be urged radially outward from the assembly responsive to the powered device being longitudinally moved along the production tube to engage the extending orientation means with the orientation profile and to orient the powered device, so that the first power connector and second power connector are aligned circumferentially to connect the powered device to the power line in an automatic manner;

wherein when the extending orientation means engages with the orientation profile, the second power connector is activated; and wherein the second power connector is configured to move independently of the longitudinal movement of the powered device, following activation of the second power connector, radially outward, following orientation of the powered device, to a position in alignment with the first power connector.

2. A system according to claim 1, wherein the extending orientation means is prevented from extending radially by a first restraining means in the assembly, the first restraining means being released upon the assembly reaching a predetermined depth.

3. A system according to claim 2, wherein the release of the extending orientation means by the first restraining means is activated by a particular well pressure.

4. A system according to claim 2, wherein there is provided inlet slots for the flow of well fluid from outside the production tube to inside the production tube.

5. A system according to according to claim 4, wherein the production tube includes a widened inner diameter above the inlets.

6. A system according to claim 1, wherein the second power connector is capable of radial outward movement from the assembly, and whose radial outward movement is constrained by a second restraining means, the second restraining means being released upon the assembly reaching a predetermined depth.

7. A system according to claim 6, wherein the release of the second power connector is constrained by the position of the extending orientation means.

8. A system according to claim 6, wherein there is provided inlet slots for the flow of well fluid from outside the production tube to inside the production tube.

9. A system according to according to claim 8, wherein the production tube includes a widened inner diameter above the inlets.

10. A system according to claim 6, wherein the second power connector moves radially outward into a window in the production tube above the first power connector.

11. A system according to claim 1, wherein the powered device is a submersible pump and an electric motor.

12. A system according to claim 11, wherein there is provided inlet slots for the flow of well fluid from outside the production tube to inside the production tube.

13. A system according to according to claim 12, wherein the production tube includes a widened inner diameter above the inlets.

14. A system according to claim 1, comprising inlet slots for the flow of well fluid from outside the production tube to inside the production tube.

15. A system according to according to claim 14, wherein the production tube includes a widened inner diameter above the inlets.

16. A system according to claim 1, wherein the second power connector moves radially outward into a window in the production tube above the first power connector.

17. An assembly, comprising:

a powered device including a second power connector; and an extending orientation means capable of radial outward movement from the assembly configured to be urged radially outward from the assembly responsive to the powered device being longitudinally moved along a production tube to engage the extending orientation means with an orientation profile disposed in the vicinity of a first power connector terminating a power line disposed on the production tube to orient the powered device, so that the second power connector and the first power connector are aligned circumferentially;

wherein the second power connector is activated in response to the extending orientation means engaging with the orientation profile; and wherein the second power connector is configured to move radially outward, independently of the longitudinal movement of the powered device along the production tube, following activation of the second power connector, and following orientation of the powered device, to engage the first power connector to connect the powered device to the power line in an automatic manner.

18. An assembly according to claim 17, wherein the second power connector moves radially outward into a window in the production tube above the first power connector.

* * * * *